US009742088B1

(12) United States Patent
Pickel et al.

(10) Patent No.: US 9,742,088 B1
(45) Date of Patent: Aug. 22, 2017

(54) ELECTRICAL CONNECTOR AND ELECTRICAL CONTACT CONFIGURED TO REDUCE RESONANCE ALONG A STUB PORTION

(71) Applicant: TYCO ELECTRONICS CORPORATION, Berwyn, PA (US)

(72) Inventors: Justin Dennis Pickel, Hummelstown, PA (US); Timothy Robert Minnick, Enola, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/189,600

(22) Filed: Jun. 22, 2016

(51) Int. Cl.

| | |
|---|---|
| ***H01R 24/00*** | (2011.01) |
| ***H01R 13/03*** | (2006.01) |
| ***H01R 13/646*** | (2011.01) |
| ***H01R 12/73*** | (2011.01) |

(52) U.S. Cl.
CPC ..... *H01R 13/03* (2013.01); *H01R 12/737* (2013.01); *H01R 13/646* (2013.01)

(58) Field of Classification Search
CPC .... H01R 13/646; H01R 13/658; H01R 13/03; H01R 13/514; H01R 13/516; H01R 12/737; H01R 43/16
See application file for complete search history.

(56) References Cited

U.S. PATENT DOCUMENTS

| | | | | |
|---|---|---|---|---|
| 8,110,500 | B2 | 2/2012 | Mutnury et al. | |
| 8,944,831 | B2 * | 2/2015 | Stoner | H01R 13/658 439/108 |
| 9,048,583 | B2 * | 6/2015 | Johnescu | H01R 13/514 |
| 9,257,778 | B2 * | 2/2016 | Buck | H01R 13/516 |
| 9,520,689 | B2 * | 12/2016 | Cartier, Jr. | H01R 43/16 |
| 9,525,256 | B2 * | 12/2016 | Laurx | H01R 12/737 |
| 2012/0202395 | A1 | 8/2012 | Gailus et al. | |
| 2013/0273781 | A1 | 10/2013 | Buck et al. | |

OTHER PUBLICATIONS

De Oliveria et al.; Measurement of the Nanoscale Roughness by Atomic Force Microscopy: Basic Principles and Applications; 2012; 29 pages.

(Continued)

*Primary Examiner* — Jean F Duverne

(57) ABSTRACT

Electrical contact or electrical connector having the electrical contact. The electrical contact has a mating segment that is configured to engage another contact and has a contact end and a contact surface. The contact surface includes a mating zone that is located a distance from the contact end. The mating zone is configured to intimately engage the other contact for electrical communication between the electrical contact and the other contact. The mating segment has a stub portion that extends between the contact end and the mating zone. At least a portion of the contact surface along the stub portion has a textured area that is more textured than the contact surface at the mating zone. The textured area is configured to dampen reflected energy that propagates between the mating zone and the contact end.

20 Claims, 7 Drawing Sheets

(56) References Cited

OTHER PUBLICATIONS

Butler et al.; Applied Research Laboratory Technical Report: Effects of Surface Roughness and Aging on the Electrical Contact Resistance and Residual Stress in Gold-Nickel-Copper Connector Materials; Dec. 2014; 179 pages.
Michael Zecchino; Why Average Roughness is Not Enough; Mar. 2003; 4 pages.
Amleshi et al.; Interconnect Design Optimization and Characterization for Advanced High Speed Backplane Channel Links; 2009; 38 pages.
Zyco Corporation; Surface Texture Parameters; Apr. 2013; 20 pages.
D J Whitehouse; Surface Metrology; Meas. Sci. Technol. 9 (1997) 18 pages.

* cited by examiner

ELECTRICAL CONNECTOR AND ELECTRICAL CONTACT CONFIGURED TO REDUCE RESONANCE ALONG A STUB PORTION

BACKGROUND

The subject matter herein relates generally to electrical contacts having stub portions that generate an electrical resonance during operation.

Electrical connectors are used to transmit data in various industries. The electrical connectors are often configured to repeatedly engage and disengage complementary electrical connectors. The process of mating the electrical connectors may be referred to as a mating operation. For example, in a backplane communication system, a backplane circuit board has a header connector that is configured to mate with a receptacle connector. The receptacle connector is typically mounted to a daughter card. The header connector includes an array of electrical contacts (hereinafter referred to as "header contacts"), and the receptacle connector includes a complementary array of electrical contacts (hereinafter referred to as "receptacle contacts"). During the mating operation, the receptacle contacts mechanically engage and slide along the corresponding header contacts. The sliding engagement between the receptacle and header contacts may be referred to as a wiping action, because each receptacle contact wipes along a contact surface of the corresponding header contact.

During this wiping action, each receptacle contact typically slides from a contact end of the corresponding header contact toward a mating zone along the header contact. The mating zone is a distance away from the contact end of the header contact. The portion of the header contact that extends between the contact end and the mating zone is referred to as a stub portion. During operation of the system, energy propagates from the mating zone to the contact end of the header contact where the energy is then reflected back toward the mating zone. The reflected energy may resonate and cancel incoming energy that propagates in the opposite direction along the header contact. This may cause, for example, a lower insertion loss within a particular frequency band.

Other types of connectors include electrical contacts that have stub portions during operation. The stub portions may exist with or without the wiping action described above. In addition to electrical contacts that transmit data signals, electrical resonance can also occur along ground contacts (or conductors). Electrical resonance along ground contacts may also produce unwanted effects.

Accordingly, a need remains for electrical contacts that reduce the unwanted effects of reflected energy along stub portions of the electrical contacts.

BRIEF DESCRIPTION

In an embodiment, an electrical connector is provided that includes a connector housing configured to engage another connector and a contact array that includes a plurality of electrical contacts coupled to the connector housing. Each of the electrical contacts includes a contact body having a mating segment and a base segment. The base segment is coupled to the connector housing. The mating segment extends in a direction from the base segment toward a contact end of the corresponding contact body. The mating segment has a contact surface that includes a mating zone located a distance from the contact end. The mating segment is configured to intimately engage another contact of the other connector at the mating zone for electrical communication between the electrical contact and the other contact. The mating segment has a stub portion that extends between the contact end and the mating zone. At least a portion of the contact surface along the stub portion has a textured area that is more textured than the contact surface at the mating zone. The textured area is configured to dampen reflected energy that propagates between the mating zone and the contact end.

In some aspects, the stub portion has a wipe runway located between the contact end and the mating zone. The contact surface may include a smooth area along the wipe runway. The other contact may be configured to slide along the wipe runway and the smooth area during a mating operation.

In some aspects, the wipe runway extends from the contact end to the mating zone. The smooth area may extend continuously between the contact end and the mating zone. In some aspects, the wipe runway is a first wipe runway. The respective contact body may include a second wipe runway that is separate from and parallel to the first wipe runway. In some aspects, the wipe runway may include the smooth area and at least a portion of the textured area.

In some aspects, the stub portion has a plating layer. The plating layer may include a ferromagnetic material that increases a dampening effect of the textured area.

In some aspects, the contact body includes an intervening layer and a plating layer that is plated over the intervening layer. The plating layer may include the textured area. The intervening layer may have a textured surface that causes the textured area along the plating layer.

In some aspects, the textured area has at least one of (a) an average surface roughness that is at least two-and-a-half times (2.5×) an average surface roughness of the mating zone; (b) a root mean square roughness that is at least two-and-a-half times (2.5×) the root mean square roughness of the mating zone; or (c) a developed surface area ratio with respect to the mating zone that is at least 2.5:1.

In an embodiment, an electrical contact is provided that includes a mating segment configured to engage another contact and has a contact end and a contact surface. The contact surface includes a mating zone that is located a distance from the contact end. The mating zone is configured to intimately engage the other contact for electrical communication between the electrical contact and the other contact. The mating segment has a stub portion that extends between the contact end and the mating zone. At least a portion of the contact surface along the stub portion has a textured area that is more textured than the contact surface at the mating zone. The textured area is configured to dampen reflected energy that propagates between the mating zone and the contact end.

In some aspects, the stub portion has a wipe runway located between the contact end and the mating zone. The contact surface includes a smooth area along the wipe runway. The other contact is configured to slide along the wipe runway and the smooth area during a mating operation.

In some aspects, the wipe runway extends from the contact end to the mating zone. The smooth area may extend continuously between the contact end and the mating zone.

In some aspects, the wipe runway is a first wipe runway. The contact surface may include a second wipe runway that is separate from and parallel to the first wipe runway.

In some aspects, the electrical contact includes an intervening layer and a plating layer that is plated over the intervening layer. The plating layer may include the textured area. The intervening layer may have a textured surface that causes the textured area along the plating layer.

In some aspects, the stub portion has a plating layer. The plating layer may include a ferromagnetic material that increases a dampening effect of the textured area.

In some aspects, the textured area has at least one of (a) an average surface roughness that is at least two-and-a-half times (2.5×) an average surface roughness of the mating zone; (b) a root mean square roughness that is at least two-and-a-half times (2.5×) the root mean square roughness of the mating zone; or (c) a developed surface area ratio with respect to the mating zone that is at least 2.5:1.

In an embodiment, an electrical contact is provided that includes a mating segment configured to engage another contact and having a contact end and a contact surface. The contact surface includes a mating zone that is located a distance from the contact end. The mating zone is configured to intimately engage the other contact for electrical communication between the electrical contact and the other contact. The mating segment has a stub portion that extends between the contact end and the mating zone. At least a portion of the contact surface along the stub portion having a textured area that is configured to dampen reflected energy that propagates between the mating zone and the contact end. The textured area has an average surface roughness of at least 1.0 μm.

In some aspects, an average surface roughness of the textured area is at least 2.0 μm and the mating zone has an average surface roughness of at most 0.7 μm.

DETAILED DESCRIPTION

Figure 1:
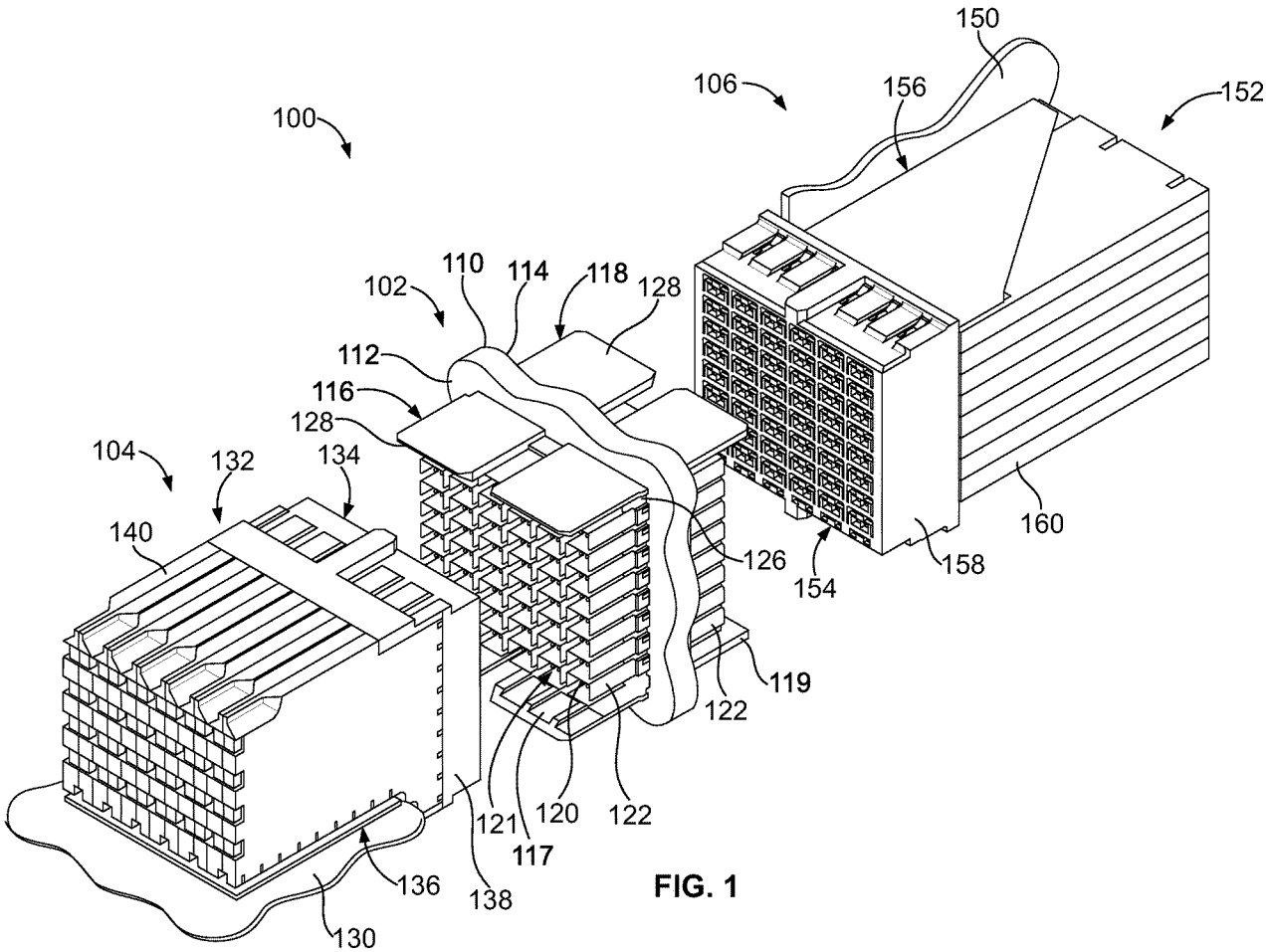
FIG. 1 is a front perspective view of a communication system formed in accordance with an embodiment.

Embodiments set forth herein may include electrical contacts, electrical connectors having the electrical contacts, and communication systems having the electrical connectors. Embodiments may be configured to improve electrical performance by, for example, damping or impeding electrical resonance that may occur in stub portions of electrical contacts. The electrical contacts may form signal paths in which data signals are transmitted through the electrical contacts. Alternatively, the electrical contacts may form ground conductors in which each ground conductor shields adjacent signal paths from one another and provides a return path. Each electrical contact is configured to be engaged by another contact at a mating zone. The mating zone is located a distance away from an end of the electrical contact thereby forming the stub portion. More specifically, the stub portion is the portion of the electrical contact in which energy resonates between the end of the electrical contact and the mating zone.

In some embodiments, the electrical connectors are configured to mate with other electrical connectors during a mating operation. During the mating operation, a first electrical contact of one connector may engage and slide (or wipe) along a second electrical contact of the other connector. The second electrical contact may include, among other things, a wipe runway that leads to the mating zone. The first electrical contact slides along the wipe runway of the second electrical contact and operably engages the second electrical contact at the mating zone.

Although the illustrated embodiment includes electrical connectors that are used in high-speed communication systems, such as backplane or midplane communication systems, it should be understood that embodiments may be used in other communication systems or in other systems/devices that utilize electrical contacts having stub portions. It should also be understood that embodiments do not require a wiping action between two electrical contacts for a stub portion to exist. Accordingly, the inventive subject matter is not limited to the illustrated embodiment.

To impede or reduce the unwanted effects of electrical resonance, embodiments described herein include electrical contacts having a more textured surface along the stub portion. In this context, texture refers to a quality of the surface of the electrical contact. For example, a surface may have varying degrees of smoothness, roughness, or waviness. As used herein, an area-of-interest of a surface is "more textured" than another area if the area-of-interest is rougher and/or wavier than the other area. A textured area is more textured than a smooth area if the textured area is at least two times (2×) rougher or wavier than the smooth area based on a surface parameter. Surface parameters that may be used to determine whether one area is more textured than another area include an average surface roughness, a root-mean-square average roughness, or a developed surface area ratio.

Electrical contacts described herein may include a plurality of different materials. For example, an electrical contact may include a base material, such as copper or copper alloy (e.g., beryllium copper), that is plated or coated with one or more other materials. As used herein, when another material is "plated over" or "coated over" a base material, the other material may directly contact or bond to an outer surface of the base material or may directly contact or bond to an outer surface of an intervening material. More specifically, the other material is not required to be directly adjacent to the base material and may be separated by an intervening layer.

Different materials of an electrical contact may be selected to impede electrical resonance along the stub portion. For example, one or more of the materials used in the electrical contacts may be ferromagnetic. More specifically, one or more materials may have a higher relative magnetic permeability. In particular embodiments, the electrical contact includes a material that has a permeability that is, for example, greater than 50. In some embodiments, the permeability is greater than 75 or, more specifically, greater than 100. In certain embodiments, the permeability is greater than 150 or, more specifically, greater than 200. In particular embodiments, the permeability is greater than 250, greater than 350, greater than 450, greater than 550, or more. Non-limiting examples of such materials include nickel, carbon steel, ferrite (nickel zinc or manganese zinc), cobalt, martensitic stainless steel, ferritic stainless steel, iron, or alloys of the same. In some embodiments, the material is a martensitic stainless steel (annealed). Materials that have a higher permeability provide a higher internal self-inductance. High permeability may also cause shallow skin depths, which may increase the effective resistance of the electrical contact within a predetermined frequency band.

In particular embodiments, the electrical contacts provide signal pathways for transmitting data signals. Embodiments may be particularly suitable for communication systems, such as network systems, servers, data centers, and the like, in which the data rates may be greater than ten (10) gigabits/second (Gbps) or greater than five (5) gigahertz (GHz). One or more embodiments may be configured to transmit data at a rate of at least 20 Gbps, at least 40 Gbps, at least 56 Gbps, or more. One or more embodiments may be configured to transmit data at a frequency of at least 10 GHz, at least 20 GHz, at least 28 GHz, or more. As used herein with respect to data transfer, the term "configured to" does not mean mere capability in a hypothetical or theoretical sense, but means that the embodiment is designed to transmit data at the designated rate or frequency for an extended period of time (e.g., expected time periods for commercial use) and at a signal quality that is sufficient for its intended commercial use. It is contemplated, however, that other embodiments may be configured to operate at data rates that are less than 10 Gbps or operate at frequencies that are less than 5 GHz.

Various embodiments may be configured for certain applications. One or more embodiments may be configured for backplane or midplane communication systems. For example, one or more of the electrical connectors described herein may be similar to electrical connectors of the STRADA Whisper or Z-PACK TinMan product lines developed by TE Connectivity. The electrical connectors may include high-density arrays of electrical contacts. A high-density array may have, for example, at least 12 signal contacts per 100 $mm^2$ along the mating side or the mounting side of the electrical connector. In more particular embodiments, the high-density array may have at least 20 signal contacts per 100 $mm^2$.

Non-limiting examples of some applications that may use embodiments set forth herein include host bus adapters (HBAs), redundant arrays of inexpensive disks (RAIDs), workstations, servers, storage racks, high performance computers, or switches. Embodiments may also include electrical connectors that are small-form factor connectors. For example, the electrical connectors may be configured to be compliant with certain standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard.

As used herein, phrases such as "a plurality of [elements]" and "an array of [elements]" and the like, when used in the detailed description and claims, do not necessarily include each and every element that a component may have. The component may have other elements that are similar to the plurality of elements. For example, the phrase "a plurality of electrical contacts [being/having a recited feature]" does not necessarily mean that each and every electrical contact of the component has the recited feature. Other electrical contacts may not include the recited feature. Accordingly, unless explicitly stated otherwise (e.g., "each and every electrical contact of the electrical connector [being/having a recited feature]"), embodiments may include similar elements that do not have the recited features.

In order to distinguish similar elements in the detailed description and claims, various labels may be used. For example, an electrical connector may be referred to as a header connector, a receptacle connector, or a mating connector. Electrical contacts may be referred to as header contacts, receptacle contacts, or mating contacts. When similar elements are labeled differently (e.g., receptacle contacts and mating contacts), the different labels do not necessarily require structural differences.

FIG. 1 is a perspective view of a communication system 100 formed in accordance with an embodiment. In particular embodiments, the communication system 100 may be a backplane or midplane communication system. The communication system 100 includes a circuit board assembly 102, a first connector system (or assembly) 104 configured to be coupled to one side of the circuit board assembly 102, and a second connector system (or assembly) 106 configured to be coupled to an opposite side the circuit board assembly 102. The circuit board assembly 102 is used to electrically connect the first and second connector systems 104, 106. Optionally, either of the first and second connector systems 104, 106 may be part of a line card assembly or a switch card assembly. Although the communication system 100 is configured to interconnect two connector systems in the illustrated embodiment, other communication systems may interconnect more than two connector systems or, alternatively, interconnect a single connector system to another communication device.

The circuit board assembly 102 includes a circuit board 110 having a first board side 112 and second board side 114. In some embodiments, the circuit board 110 may be a backplane circuit board, a midplane circuit board, or a motherboard. The circuit board assembly 102 includes a first header connector 116 mounted to and extending from the first board side 112 of the circuit board 110. The circuit board assembly 102 also includes a second header connector 118 mounted to and extending from the second board side 114 of the circuit board 110. The first and second header connectors 116, 118 include connector housings 117, 119, respectively. The first and second header connectors 116, 118 also include corresponding electrical contacts 120 that are electrically connected to one another through the circuit board 110. The electrical contacts 120 are hereinafter referred to as header contacts 120.

The circuit board assembly 102 includes a plurality of signal paths therethrough defined by the header contacts 120 and conductive vias 170 (shown in FIG. 2) that extend through the circuit board 110. The header contacts 120 of the first and second header connectors 116, 118 may be received in the same conductive vias 170 to define a signal path directly through the circuit board 110. In an exemplary embodiment, the signal paths pass straight through the circuit board assembly 102 in a linear manner. Alternatively, the header contacts 120 of the first header connector 116 and the header contacts 120 of the second header connector 118 may be inserted into different conductive vias 170 that are electrically coupled to one another through traces (not shown) of the circuit board 110.

The first and second header connectors 116, 118 include ground shields or contacts 122 that provide electrical shielding around corresponding header contacts 120. In an exemplary embodiment, the header contacts 120 are arranged in signal pairs 121 and are configured to convey differential signals. Each of the ground shields 122 may peripherally surround a corresponding signal pair 121. As shown, the ground shields 122 are C-shaped or U-shaped and cover the corresponding signal pair 121 along three sides.

The connector housings 117, 119 couple to and hold the header contacts 120 and the ground shields 122 in designated positions relative to each other. The connector housings 117, 119 may be manufactured from a dielectric material, such as a plastic material. Each of the connector housings 117, 119 includes a mounting wall 126 that is configured to be mounted to the circuit board 110 and shroud walls 128 that extend from the mounting wall 126. The shroud walls 128 cover portions of the header contacts 120 and the ground shields 122.

The first connector system 104 includes a first circuit board 130 and a first receptacle connector 132 that is mounted to the first circuit board 130. The first receptacle connector 132 is configured to be coupled to the first header connector 116 of the circuit board assembly 102 during a mating operation. The first receptacle connector 132 has a mating interface 134 that is configured to be mated with the first header connector 116. The first receptacle connector 132 has a board interface 136 configured to be mated with the first circuit board 130. In an exemplary embodiment, the board interface 136 is oriented perpendicular to the mating interface 134. When the first receptacle connector 132 is coupled to the first header connector 116, the first circuit board 130 is oriented perpendicular to the circuit board 110.

The first receptacle connector 132 includes a front housing or shroud 138. The front housing 138 is configured to hold a plurality of contact modules 140 side-by-side. As shown, the contact modules 140 are held in a stacked configuration generally parallel to one another. In some embodiments, the contact modules 140 hold a plurality of electrical contacts 142 (shown in FIGS. 3 and 4) that are electrically connected to the first circuit board 130. The electrical contacts 142 are hereinafter referred to as receptacle contacts 142. The receptacle contacts 142 are configured to be electrically connected to the header contacts 120 of the first header connector 116.

The second connector system 106 includes a second circuit board 150 and a second receptacle connector 152 coupled to the second circuit board 150. The second receptacle connector 152 is configured to be coupled to the second header connector 118 during a mating operation. The second receptacle connector 152 has a mating interface 154 configured to be mated with the second header connector 118. The second receptacle connector 152 has a board interface 156 configured to be mated with the second circuit board 150. In an exemplary embodiment, the board interface 156 is oriented perpendicular to the mating interface 154. When the second receptacle connector 152 is coupled to the second header connector 118, the second circuit board 150 is oriented perpendicular to the circuit board 110.

Figure 3:
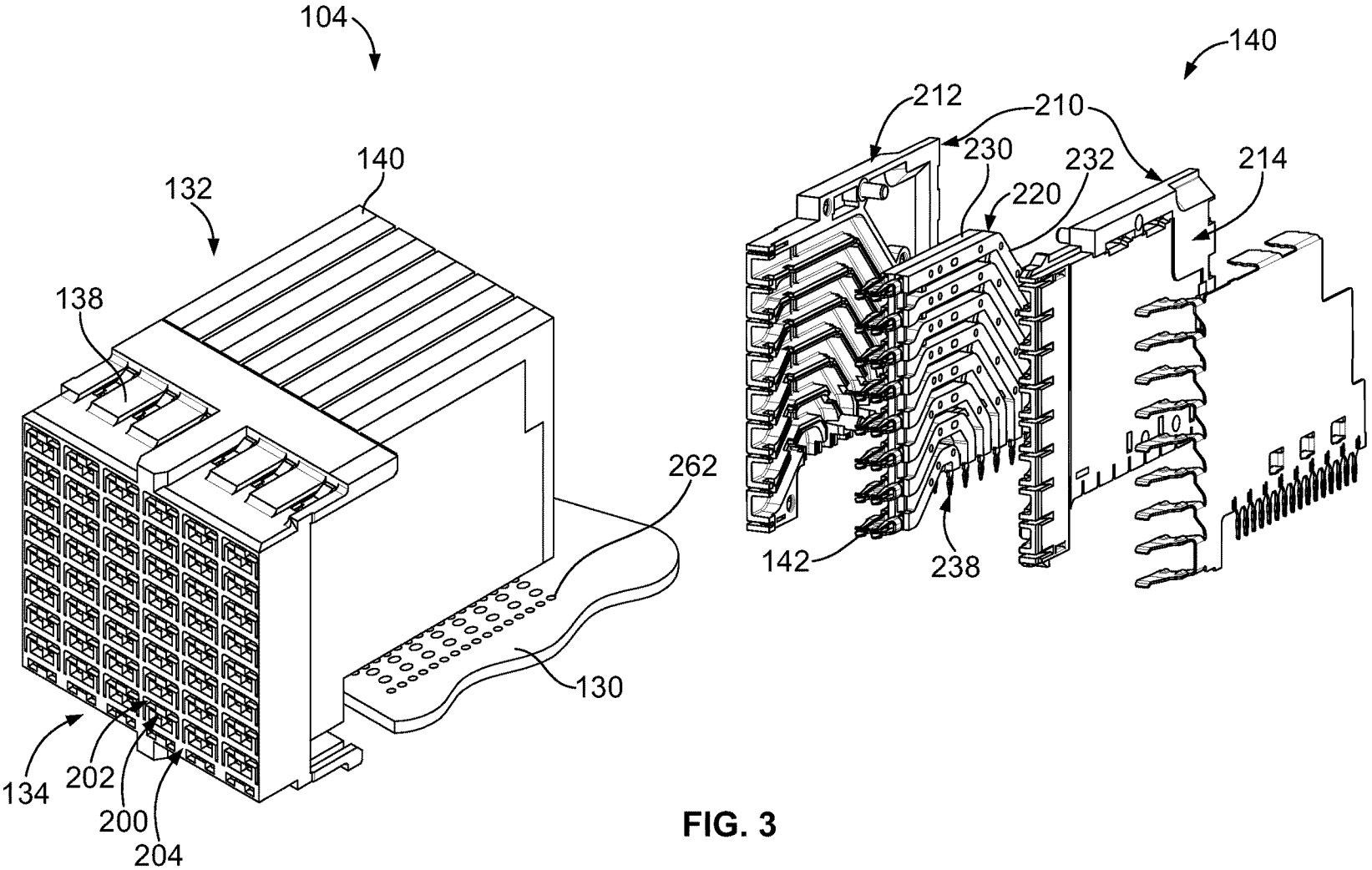
FIG. 3 is a perspective view of a receptacle connector that may be used with the communication system of FIG. 1.

Similar to the first receptacle connector 132, the second receptacle connector 152 includes a front housing 158 used to hold a plurality of contact modules 160. The contact modules 160 are held in a stacked configuration generally parallel to one another. The contact modules 160 hold a plurality of receptacle contacts (not shown) that are electrically connected to the second circuit board 150. The receptacle contacts are configured to be electrically connected to the header contacts 120 of the second header connector 118. The receptacle contacts of the contact modules 160 may be similar or identical to the receptacle contacts 142 (FIG. 3).

In the illustrated embodiment, the first circuit board 130 is oriented generally horizontally. The contact modules 140 of the first receptacle connector 132 are oriented generally vertically. The second circuit board 150 is oriented generally vertically. The contact modules 160 of the second receptacle connector 152 are oriented generally horizontally. As such, the first connector system 104 and the second connector system 106 may have an orthogonal orientation with respect to one another.

Although not shown, in some embodiments, the communication system 100 may include a loading mechanism. The loading mechanism may include, for example, latches or levers that fully mate the corresponding receptacle and header connectors. For instance, the loading mechanism may be operably coupled to the receptacle connector 132 and, when actuated, drive the receptacle connector 132 into the header connector 116 to assure that the receptacle and header connectors 132, 116 are fully mated.

Figure 2:
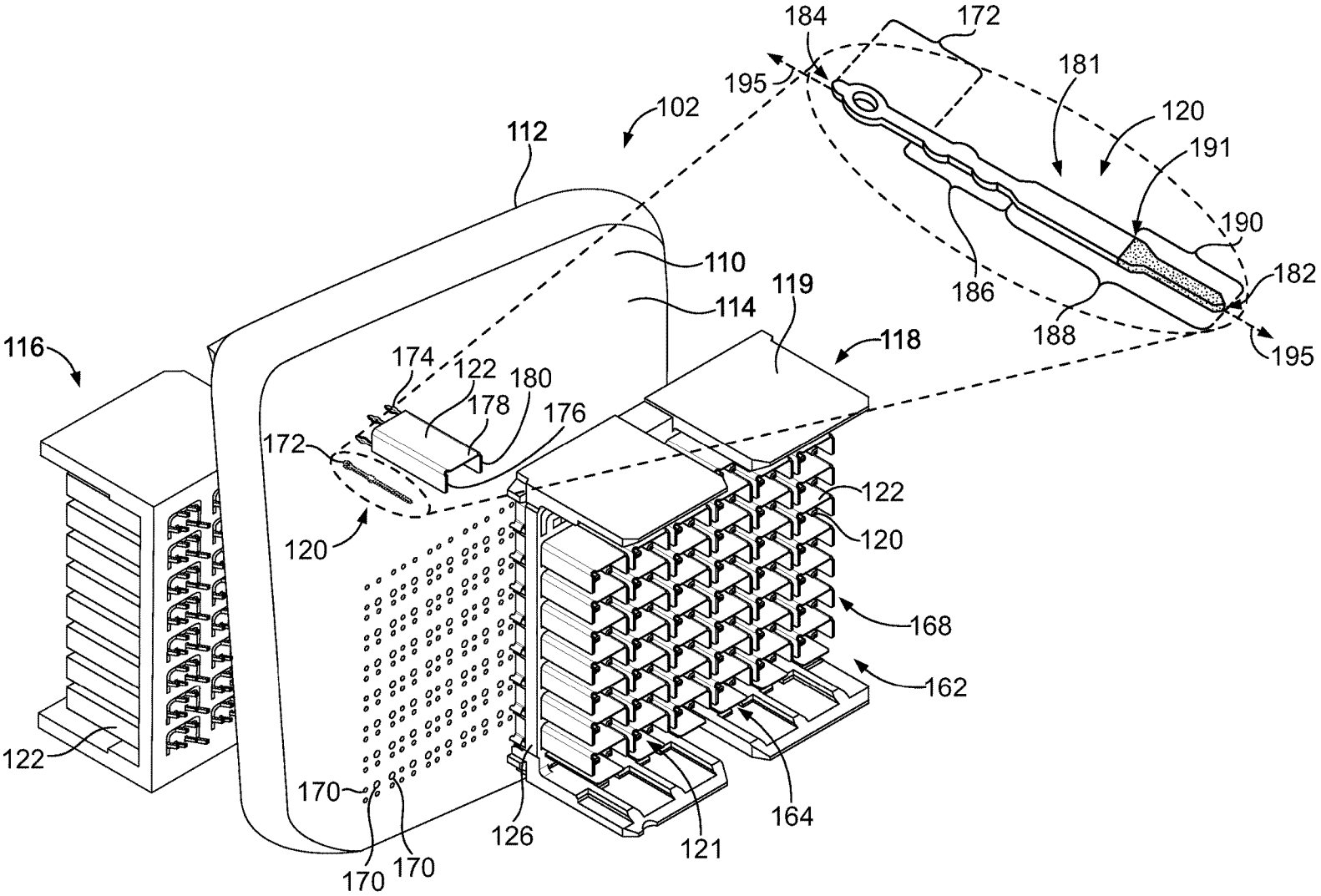
FIG. 2 is a perspective view of a circuit board assembly including a header connector that may be used with the communication system of FIG. 1.

FIG. 2 is a partially exploded view of the circuit board assembly 102 showing the first and second header connectors 116, 118 positioned for mounting to the circuit board 110. Although the following description is with respect to the second header connector 118, the description is also applicable to the first header connector 116. As shown, the connector housing 119 includes a contact end 162 that faces away from the second board side 114 of the circuit board 110. The connector housing 119 defines a housing cavity 164 that opens to the contact end 162 and is configured to receive the second receptacle connector 152 (FIG. 1) when the second receptacle connector 152 is advanced into the housing cavity 164. As shown, the second header connector 118 includes a contact array 168 that includes the header contacts 120 and the ground shields 122. The contact array 168 may include multiple signal pairs 121.

The conductive vias 170 extend into the circuit board 110. In an exemplary embodiment, the conductive vias 170 extend entirely through the circuit board 110 between the first and second board sides 112, 114. In other embodiments, the conductive vias 170 extend only partially through the circuit board 110. The conductive vias 170 are configured to receive the header contacts 120 of the first and second header connectors 116, 118. For example, the header contacts 120 include compliant pins 172 that are configured to be loaded into corresponding conductive vias 170. The compliant pins 172 mechanically engage and electrically couple to the conductive vias 170. Likewise, at least some of the conductive vias 170 are configured to receive compliant pins 174 of the ground shields 122. The compliant pins 174 mechanically engage and electrically couple to the conductive vias 170. The conductive vias 170 that receive the ground shields 122 may surround the pair of conductive vias 170 that receive the corresponding pair of header contacts 120.

The ground shields 122 are C-shaped and provide shielding on three sides of the signal pair 121. The ground shields 122 have a plurality of walls, such as three planar walls 176, 178, 180. The planar walls 176, 178, 180 may be integrally formed or alternatively, may be separate pieces. The compliant pins 174 extend from each of the planar walls 176, 178, 180 to electrically connect the planar walls 176, 178, 180 to the circuit board 110. The planar wall 178 defines a center wall or top wall of the ground shield 122. The planar walls 176, 180 define side walls that extend from the planar wall 178. The planar walls 176, 180 may be generally perpendicular to the planar wall 178. In alternative embodiments, other configurations or shapes for the ground shields 122 are possible in alternative embodiments. For example, more or fewer walls may be provided in alternative embodiments. The walls may be bent or angled rather than being planar. In other embodiments, the ground shields 122 may provide shielding for individual header contacts 120 or sets of contacts having more than two header contacts 120.

An enlarged view of the header contact 120 is also shown in FIG. 2. The header contact 120 includes a contact end 182 and a back end 184. A conductive pathway exists between the contact and back ends 182, 184. The back end 184 is configured to engage the circuit board 110. The contact end 182 may represent the portion of the header contact 120 that is located furthest from the circuit board 110 or the mounting wall 126 and is the first to engage or interface with the second receptacle connector 152 (FIG. 1). As such, the contact end 182 may also be referred to as the leading end or the mating end.

The header contact 120 has a central line 195 extending therethrough between the back end 184 and the contact end 182. The central line 195 may extend through an approximate center of the header contact 120. In FIG. 2, the header contact 120 is essentially linear. It should be understood, however, that the header contact 120 may have a non-linear shape in other embodiments.

The header contact 120 also includes a contact body 181. The header contact 120 (or the contact body 181) includes a plurality of segments that are shaped differently from one another and may have different functions. For example, the header contact 120 includes the compliant pin 172, a base segment 186, and a mating segment 188. The compliant pin 172 includes the back end 184, and the mating segment 188 includes the contact end 182. As described above, the compliant pin 172 mechanically engages and electrically couples to a corresponding conductive via 170 of the circuit board 110.

The base segment 186 is sized and shaped to directly engage the mounting wall 126 of the connector housing 119. For example, the base segment 186 may be inserted into a passage (not shown) of the mounting wall 126 and engage the mounting wall 126 to form an interference fit therewith.

The mating segment 188 may represent the portion of the header contact 120 that is exposed within the housing cavity 164. As described below, the mating segment 188 (or a portion thereof) is configured to slidably engage a corresponding receptacle contact 142 (shown in FIG. 3) during the mating operation. When the header contact 120 is operably engaged to the receptacle contact 142, a stub portion 190 of the mating segment 188 extends between the contact end 182 and a mating zone 191 where the receptacle contact 142 engages the header contact 120. The stub portion 190 may include a textured area 192 (indicated by shading) that is configured to dampen energy that is reflected between the contact end 182 and the mating zone 191.

FIG. 3 is a partially exploded view of the first connector system 104 including the first receptacle connector 132. Although the following description is with respect to the first receptacle connector 132, the description is also applicable to the second receptacle connector 152 (FIG. 1). FIG. 3 illustrates one of the contact modules 140 in an exploded state. The front housing 138 includes a plurality of contact openings 200, 202 at a contact end 204 of the front housing 138. The contact end 204 defines the mating interface 134 of the first receptacle connector 132 that engages the first header connector 116 (FIG. 1).

The contact modules 140 are coupled to the front housing 138 such that the receptacle contacts 142 are received in corresponding contact openings 200. Optionally, a single receptacle contact 142 may be received in each contact opening 200. The contact openings 200 receive corresponding header contacts 120 (FIG. 1) therein when the receptacle and header connectors 132, 116 are mated. The contact openings 202 receive corresponding ground shields 122 (FIG. 1) therein when the receptacle and header connectors 132, 116 are mated.

The front housing 138 may be manufactured from a dielectric material, such as a plastic material, and may provide isolation between the contact openings 200 and the contact openings 202. The front housing 138 may isolate the receptacle contacts 142 and the header contacts 120 from the ground shields 122. In some embodiments, the contact module 140 includes a conductive holder 210. The conductive holder 210 may include a first holder member 212 and a second holder member 214 that are coupled together. The holder members 212, 214 may be fabricated from a conductive material. As such, the holder members 212, 214 may provide electrical shielding for the first receptacle connector 132. When the holder members 212, 214 are coupled together, the holder members 212, 214 define at least a portion of a shielding structure.

The conductive holder 210 is configured to support a frame assembly 220 that includes a pair of dielectric frames 230, 232. The dielectric frames 230, 232 are configured to surround signal conductors (not shown) that are electrically coupled to or include the receptacle contacts 142. Each signal conductor may also be electrically coupled to or may include a mounting contact 238. The mounting contacts 238 are configured to mechanically engage and electrically couple to conductive vias 262 of the first circuit board 130. Each of the receptacle contacts 142 may be electrically coupled to a corresponding mounting contact 238 through the signal conductor (not shown).

Figure 4:
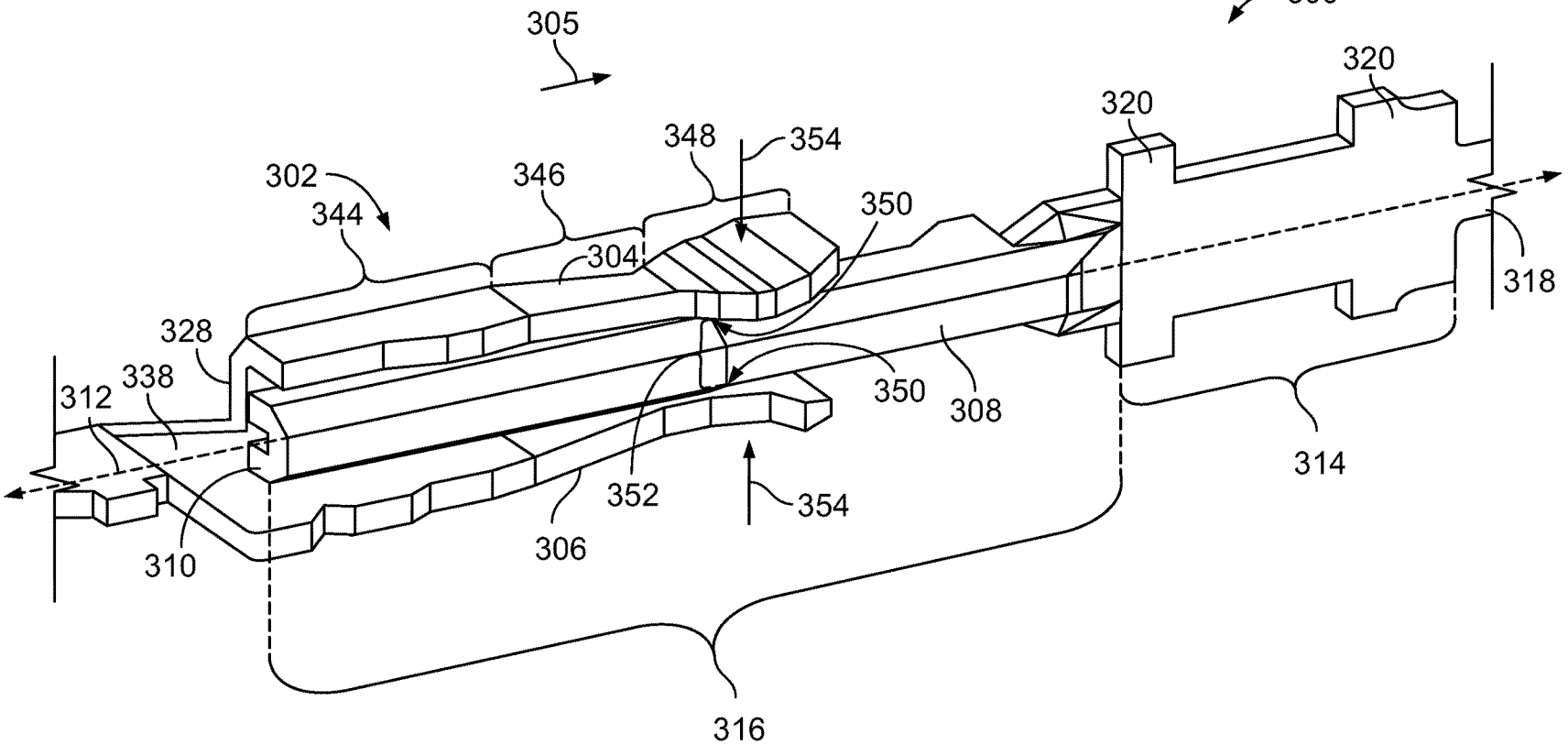
FIG. 4 is an isolated perspective view of an electrical contact and another contact operably engaged to each other in accordance with an embodiment in which the electrical contact has a textured area along a stub portion.

FIG. 4 is an isolated perspective view of an electrical contact 300 formed in accordance with an embodiment that is operably engaged to another contact 302 having first and second contact fingers 304, 306. In other embodiments, the other contact 302 may have only a single contact finger or more than two contact fingers. In some embodiments, the electrical contact 300 is a header contact and may be used as the header contact 120 (FIG. 1) of the header connector 118 (FIG. 1). The other contact 302 may be a receptacle contact that engages the header contact, such as the receptacle contact 142 (FIG. 3). In such embodiments, the electrical contact 300 and the other contact 302 are configured to communicate data signals therebetween. It should be understood, however, that the electrical contact 300 and the other contact 302 may have different configurations and/or be used in other applications. It should also be understood that the electrical contact 300 and the other contact 302 may be ground conductors in alternative embodiments. In such embodiments, the ground conductors may shield adjacent signal conductors (or signal pairs) from one another and/or provide a return path.

The electrical contact 300 has a contact body 308 and may include features that are similar to the features of the header contact 120 (FIG. 1). For example, the electrical contact 300 includes a contact end 310. The electrical contact 300 also includes a back or proximal end (not shown) that is similar to the back end 184 (FIG. 2). The back end may be configured to engage a circuit board, such as the circuit board 110 (FIG. 1). In other embodiments, the electrical contact 300 may be a longer conductor, such as those found in lead frames.

As shown, the electrical contact 300 is oriented with respect to a central line 312 that extends therethrough between the back end and the contact end 310. The central line 312 extends through a geometric center of a cross-sectional profile of the contact body 308. In the illustrated embodiment, the central line 312 appears to be a straight line. In other embodiments, however, the central line 312 may bend as the shape of the contact body 308 changes along a length of the electrical contact 300.

The electrical contact 300 (or the contact body 308) includes a plurality of contact segments or portions that may be shaped differently from one another and/or may have different functions. For example, the electrical contact 300 includes a base segment 314 and a mating segment 316. The electrical contact 300 may also include a compliant pin 318, only a small portion of which is shown in FIG. 4. The compliant pin 318 may be similar or identical to the compliant pin 172 (FIG. 2) and include the back end (not shown) of the electrical contact 300. The mating segment 316 includes the contact end 310. The contact end 310 may represent the distal end of the electrical contact 300. In some embodiments, the contact end 310 may engage the other contact 302 before other portions of the electrical contact 300 engage the other contact 302.

The base segment 314 is sized and shaped to directly engage a connector housing (not shown), such as the connector housing 119 (FIG. 1). For example, the base segment 314 includes protrusions 320 that are configured to engage surfaces (not shown) of the connector housing. The protrusions 320 may form a frictional engagement between the electrical contact 300 and the connector housing. As shown, the base segment 314 has a planar shape, but other shapes may be used in other embodiments.

The mating segment 316 may represent the portion of the electrical contact 300 that is exposed for engaging the other contact 302 during a mating operation. In the illustrated embodiment, the mating segment 316 is configured to slidably engage the other contact 302 during the mating operation in which the other contact 302 moves in a mating direction 305. The electrical contact 300 may be stamped from a sheet of material and shaped to include the features described herein. In particular, one or more portions of the sheet of material may be textured prior to stamping. Alternatively or in addition to texturing the sheet prior to stamping, one or more portions of the electrical contact 300 may be textured after the electrical contact is stamped and formed.

The other contact 302 may be stamped from a sheet of material and be shaped to include a contact support 338 and the contact fingers 304, 306. The contact finger 306 projects from the contact support 338, and the contact finger 304 is coupled to the contact finger 306 through a joint section 328. Each of the contact fingers 304, 306 includes a coupling segment 344, a beam segment 346, and a paddle segment 348. The beam segments 346 and/or the paddle segments 348 form engagement areas 350. The engagement area 350 is an inner surface of the corresponding contact finger that engages the electrical contact 300. As shown, the engagement areas 350 of the contact fingers 304, 306 face each other with a contact-receiving space 352 therebetween. In other embodiments, the engagement areas 350 may not face each other.

During a mating operation with the electrical contact 300, the electrical contact 300 is received within the contact-receiving space 352 as the other contact 302 is advanced in the mating direction 305. The engagement areas 350 may engage respective sides of the electrical contact 300. As the electrical contact 300 is advanced through the contact-receiving space 352, the electrical contact 300 engages and deflects the contact fingers 304, 306. In the illustrated embodiment, the contact fingers 304, 306 are deflected away from each other.

When the contact fingers 304, 306 are in deflected conditions as shown in FIG. 4, each of the contact fingers 304, 306 may generate a normal force 354 that presses the corresponding engagement area 350 against a portion of the mating segment 316. The contact fingers 304, 306 may pinch the mating segment 316 of the corresponding electrical contact 300 therebetween. To ensure that a sufficient electrical connection is made between the respective contact finger and the mating segment 316, each of the contact fingers 304, 306 may be configured (e.g., sized and shaped) to generate a normal force 354 of a designated value when the corresponding contact finger is in a deflected condition.

Figure 5:
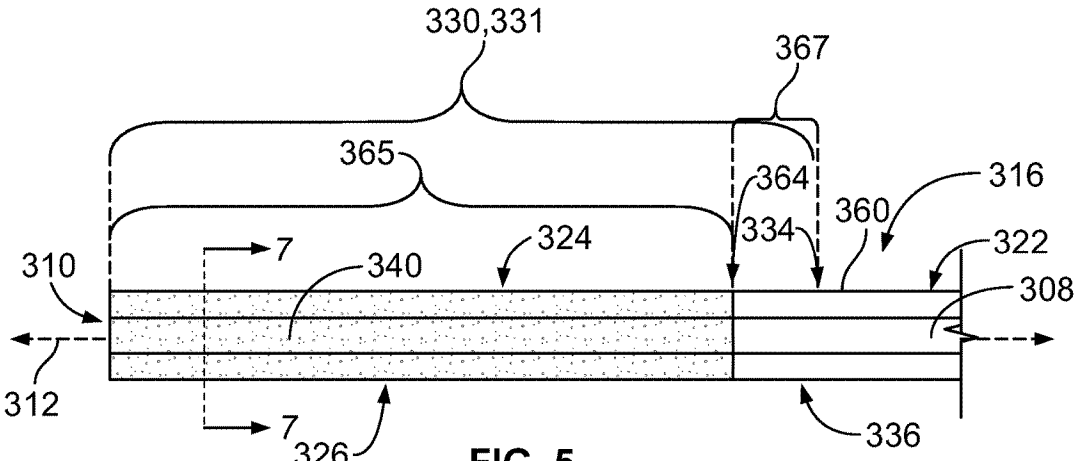
FIG. 5 is a side view of a portion of a mating segment of the electrical contact of FIG. 4.
Figure 6:
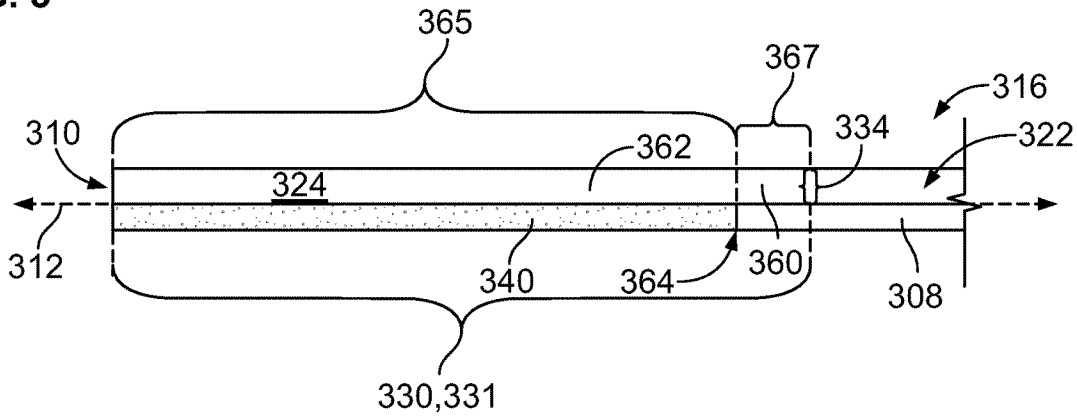
FIG. 6 is a top view of the portion of the mating segment of the electrical contact of FIG. 4.

FIG. 5 is a side view of a portion of the mating segment 316, and FIG. 6 is a top view of the same portion of the mating segment 316. The mating segment 316 has a contact surface 322 that defines an exterior of the mating segment 316 or the contact body 308. Portions of the contact surface 322 are configured to engage the other contact 302 (FIG. 4) or, more specifically, the contact fingers 304, 306 (FIG. 4). In the illustrated embodiment, the contact surface 322 includes a first wipe runway 324 and a second wipe runway 326 (FIG. 5) that are configured to engage the engagement areas 350 (FIG. 4) of the contact fingers 304, 306, respectively. The first and second runways 324, 326 are separate and extend parallel to each other. In the illustrated embodiment, the first and second runways 324, 326 face in opposite directions and extend parallel to the central line 312. The first and second runways 324, 326 represent paths along the contact surface 322 that the engagement areas 350 of the respective contact fingers 304, 306 directly engage and slide (or wipe) along during the mating operation.

In the illustrated embodiment, the first and second runways 324, 326 extend from the contact end 310 to respective mating zones 334, 336. The mating zone 336 is only shown in FIG. 5. The mating zones 334, 336 are localized areas of the contact surface 322 where the engagement areas 350 of the contact fingers 304, 306, respectively, intimately engage the mating segment 316 during operation. In other words, the mating zones and the engagement areas are small areas where an electrical connection is formed between the electrical contact 300 and the other contact 302. The mating zones 334, 336 are the final resting locations of the contact fingers 304, 306. In some cases, the mating zones 334, 336 may be identifiable based on surface characteristics of the mating segment. For example, the mating zones 334, 336 may be smoother than the textured area and/or other areas of the electrical contact 300 and may include markings that occur during extended periods of use.

The mating segment 316 includes a stub portion 330 that extends from the contact end 310 to the mating zones 334, 336. During operation, electrical energy may be reflected between the contact end 310 and the mating zones 334, 336 and resonate therebetween. Without textured areas, the resonating energy may cancel incoming electrical energy at the frequency band of interest that is based on a length of the stub portion 330. This length is represented as a distance 331 between the contact end 310 and the mating zones 334, 336. Communication systems may experience a significant drop in insertion loss at the frequency band of interest.

To reduce the unwanted effects of the resonating energy, embodiments may include one or more textured areas along the stub portion 330. Textured areas have uneven (e.g., roughened or wavy) topographies compared to smooth areas. For example, the mating segment 316 includes a textured area 340 (indicated by shading) that extends from the contact end 310 to a designated point 364. As shown in FIGS. 5 and 6, the designated point 364 along the first and second wipe runways 324, 326 may be proximate to the mating zones 334, 336, but located before the mating zones 334, 336.

The textured area 340 is configured to dampen reflected energy that propagates between the mating zones 334, 336 and the contact end 310 during operation. Textured areas may have surface irregularities including peaks and troughs at a greater density and/or a greater height difference (peak-to-trough) compared to smooth areas. Without being held to a particular theory, it is believed that that the peaks and troughs of the textured area generate a greater amount of loss as the current propagates therealong. It is also suspected that as current propagates down into a trough, it may induce current at a nearby peak. This self-inductance may generate more loss compared to smoother surfaces. In some cases, the randomness of the peaks and troughs may enhance the dampening effect. One or more of the effects described above may be particularly applicable for high speed applications because, at higher frequencies (e.g., greater than 10 GHz), current propagates proximate to or along the contact surface of the electrical contact.

Embodiments include one or more areas of the contact surface that are more textured (e.g., rougher or wavier) than the contact surface at the mating zone. The textured area may also be rougher or wavier than other areas of the electrical contact that propagate signals, such as areas along the base segment or compliant pin. Whether an area of the contact surface is a textured area may be determined by surface texture parameters, such as roughness parameters, that represent the number and extent of deviations along a surface. Textured areas may include irregular topographical deviations (e.g., caused by grinding, milling, or abrasive blasting the contact surface) or repeating topographical deviations (e.g., caused by stamping the electrical contact).

Textured areas may be manufactured through one or more processes. For example, areas of the contact body may be roughened by subtractive methods, additive methods, or other methods. Subtractive methods for providing textured areas may include mechanical, chemical, and/or thermal techniques. During a subtractive process, material from a blank (e.g., sheet of material) or a partially formed electrical contact (e.g., workpiece) may have material removed from the blank or contact body. Non-limiting examples of subtractive processes that may roughen or render the surface more wavy include sawing, shaping, stamping, drilling, milling, boring, grinding, abrasive (e.g., sand or bead) blasting, chemical milling, abrasive water-jet machining (AWJM), abrasive jet machining (AJM), abrasive grinding, electrolytic in-process dressing (ELID) grinding, casting, hot rolling, forging, electrical discharge machining (EDM), etching (e.g., physical/chemical etching, vapor phase etching, electrochemical etching (ECM), reactive-ion etching (RIE)), chemical machining (CM), electrochemical grinding (ECG), laser machining, or electron beam machining. The above list is not intended to be limiting and other subtractive techniques or processes may be used.

It is also contemplated that the textured areas may be provided by additive techniques in which material is added to the contact body. Such processes include electroplating, physical vapor deposition (PVD), evaporation (e.g., thermal evaporation), sputtering, ion plating, ion cluster beam deposition, pulsed laser deposition, chemical vapor deposition (CVD), atomic layer deposition (ALD), thermal spray deposition, diffusion, laser sputter deposition, casting, ink jet printing, electrochemical forming processes, electrodeposition, laser beam deposition, electron beam deposition, plasma spray deposition, and the like. The above list is not intended to be limiting and other additive techniques or processes may be used.

It is also contemplated that the textured areas may be provided without adding or subtracting material, such as in shaping the material. For example, a mold may be provided that is stamped into a blank that forms the electrical contact. The mold may include an exterior surface that is shaped to provide the textured area.

One parameter that may be used to determine whether the textured area is more textured than the mating zone is average surface roughness ($R_a$), which is defined in International Organization for Standards (or ISO) 25178-2 (2012) and the American Society of Mechanical Engineers (or ASME) B46.1-2009. Although the term includes roughness, waviness may also be calculated using the average surface roughness formula. Average surface roughness is an arithmetic average of the absolute values of the profile height deviations from a mean line (or plane) for a designated length (or area). In some embodiments, the textured area may have an average surface roughness that is at least two times (2×) greater than the average surface roughness of a mating zone. In some embodiments, the textured area may have an average surface roughness of at least 1.0 μm, at least 1.5 μm, at least 2.0 μm, at least 2.5 μm, at least 3 μm, or more. In certain embodiments, the textured area may have an average surface roughness of at least 5 μm, at least 10 μm, at least 15 μm, at least 20 μm, at least 30 μm, or more. The average surface roughness of the mating zone may be less than 1.0 μm. In particular embodiments, the average surface roughness of the mating zone may be less than 0.7 μm, less than 0.5 μm, or less than 0.3 μm.

Another parameter that may be used to determine whether a textured area is more textured than another area is a root mean square ($R_q$) roughness, which is defined as the root mean square (RMS) average of profile height deviations taken within an evaluation length (or area) and measured from a mean line (or plane). Root mean square (RMS) roughness is defined in ISO 25178-2 (2012) and ASME B46.1-2009. In some embodiments, the textured area may have an RMS roughness of at least 1.0 μm, at least 1.5 μm, at least 2.0 μm, at least 2.5 μm, at least 3 μm, or more. In certain embodiments, the textured area may have an RMS roughness of at least 5 μm, at least 10 μm, at least 15 μm, at least 20 μm, at least 30 μm, or more. The RMS roughness of the mating zone may be less than 1.0 μm. In particular embodiments, the RMS roughness of the mating zone may be less than 0.7 μm, less than 0.5 μm, or less than 0.3 μm.

Yet another parameter that may be used to determine whether a textured area is more textured than another area is the developed surface area ratio ($S_{dr}$), which is expressed as the percentage or factor of additional surface area contributed by the texture as compared to an area of an ideal plane along the measurement length or area. The developed surface area ratio is defined in ISO 25178-2 (2012). In some embodiments, the textured area may have a developed surface area ratio that is at least two times (2×) greater than the developed surface area ratio of the mating zone. For instance, the developed surface area ratio may be at least 2.5:1 or at least 3:1. In some embodiments, the developed surface area ratio may be at least 5:1, at least 8:1, at least 10:1, at least 15:1, at least 20:1, or a greater ratio. The developed surface area ratio of the mating zone may be less than 2:1. In particular embodiments, the developed surface area ratio of the mating zone may be less than 2.0:1 or less than 1.5:1.

Each of the above parameters (average surface roughness, RMS roughness, or developed surface area ratio) may be determined using, for example, a stylus profilometer or an optical profilometer. Each of the ISO 25178-2 (2012) and ASME B46.1-2009 is incorporated herein by reference in its entirety for calculating and measuring average surface roughness, RMS roughness, and developed surface area ratio. As one example, the optical profilometer may be configured to perform Coherence Scanning Interferometry (CSI) or white light interferometry to determine the above parameters.

In some embodiments, the textured area has at least one of (a) an average surface roughness that is at least two-and-a-half times (2.5×) an average surface roughness of the mating zone; (b) an RMS roughness that is at least two-and-a-half times (2.5×) the RMS roughness of the mating zone; or (c) a developed surface area ratio with respect to the mating zone that is at least 2.5:1. To determine the above parameters, the textured area and the mating zone should be analyzed using the same method(s). The method(s) should be accepted by manufacturers of electrical contacts (or related structures) for determining the above parameters. Such methods may be, for example, those methods used when designing machinery or during quality control. Such methods may be described in organizational standards, such as ISO 25178-2 (2012) and ASME B46.1-2009 and related sections. In some cases, the textured area and the mating zone may be analyzed using an optical profilometer that is configured to perform CSI or white light interferometry.

In certain embodiments, the textured area has at least one of (a) an average surface roughness that is at least three times (3×) an average surface roughness of the mating zone; (b) an RMS roughness that is at least three times (3×) the RMS roughness of the mating zone; or (c) a developed surface area ratio with respect to the mating zone that is at least 3:1. In more particular embodiments, the textured area has at least one of (a) an average surface roughness that is at least five times (5×) an average surface roughness of the mating zone; (b) an RMS roughness that is at least five times (5×) the RMS roughness of the mating zone; or (c) a developed surface area ratio with respect to the mating zone that is at least 5:1. Other factors or values may be used. For example, the multiplier for average surface roughness may be 7×, 10×, 15×, 20×, or more. The multiplier for RMS roughness may be 7×, 10×, 15×, 20×, or more. The ratio for developed surface area ratio may be 7:1, 10:1, 15:1, 20:1, or more.

In some embodiments, only one or two of the above parameters may be used to confirm whether an area is sufficiently textured. For example, only the average surface roughness may be used. In some cases, when two parameters are used, the textured area is sufficient if either parameter is satisfied. In other cases, the textured area may only be sufficiently textured if two of the three parameters or all three parameters are satisfied. For example, in some embodiments, the textured area is sufficiently textured only when the average surface roughness is above a designated value, the RMS roughness is above a designated value, and the developed surface area ratio is above a designated ratio. Any combination of the above parameters may be used.

Although the above examples for different parameters include multipliers or ratios with similar or identical values, different values may be used in other embodiments. For example, the textured area may have at least one of an average surface roughness that is at least three times (3×) an average surface roughness of the mating zone and an RMS roughness that is at least four times (4×) the root mean square roughness of the mating zone.

Locations of the mating zones 334, 336 relative to the textured area 340 and/or the contact end 310 may be configured based on the intended application of the electrical contact 300 and the other contact 302. For example, the locations of the mating zones 334, 336 may be determined based on the expected data rates and by dimensions of the contact fingers 304, 306 (FIG. 4) and the contact body 308. Locations of the mating zones 334, 336 may also be based on a size of the textured area 340 along the stub portion 330 and the degree to which the area is textured (e.g., roughness or waviness) for dampening the electrical resonance.

Accordingly, the location of the designated point 364 and/or the characteristics of the textured area 340 may be selected to achieve a predetermined electrical performance. Alternatively or in addition to the above, the location of the designated point 364 may be selected to achieve a certain confidence that the engagement areas 350 (FIG. 4) will sufficiently engage the mating segment 316 at a smooth area. For instance, it may be desirable for the engagement areas 350 to engage a smooth area 360 of the mating segment 316 when communicating current between the mating segment 316 and the contact fingers 304, 306. In such instances, the engagement area 350 and the smooth area 360 of the mating segment 316 may effectively contact each other at more points. In FIGS. 5 and 6, the smoother surfaces of the mating segment 316, including the smooth area 360, are not shaded, whereas the textured areas are shaded.

Accordingly, the designated point 364 may be located a distance 365 away from the contact end 310 and a distance 367 away from the respective mating zones 334, 336. It is understood that tolerances during the manufacture and assembly of the electrical contact 300 may render it difficult to locate each of the engagement areas 350 precisely at the corresponding mating zone after the mating operation. For instance, the various tolerances during manufacture and assembly may effectively result in some engagement areas 350 intimately engaging the contact surface 322 prior to the corresponding mating zone 334 shown in FIG. 5. Thus, the distance 367 between the mating zones 334, 336 and the textured area 340 may be configured to achieve a predetermined confidence that the engagement areas 350 will intimately engage the smooth area 360 of the contact surface 322 after the mating operation and will not engage the textured area 340.

Also shown in FIG. 6, the first wipe runway 324 may have a smooth area 362. The smooth area 362 extends essentially continuously from the contact end 310 to the mating zone 334. In particular embodiments, the smooth area 362 extends from the contact end 310 to the mating zone 334 such that the other contact 302 slides continuously along the smooth area 362 of the contact surface 322. The wipe runway 326 (FIG. 5) may also include a smooth area that extends essentially continuously from the contact end 310 to the mating zone 336 (FIG. 5).

The smooth areas 360, 362 may have, for example, an average surface roughness that is at most one-and-a half times (1.5×) the average surface roughness of the mating zone or an RMS roughness that is at most one-and-a half times (1.5×) the RMS roughness of the mating zone. In some embodiments, the smooth areas 360, 362 have an average surface roughness and an RMS roughness that are essentially equal (e.g., within tolerance amounts) to the average surface roughness and the RMS roughness of the mating zone.

Figure 7:
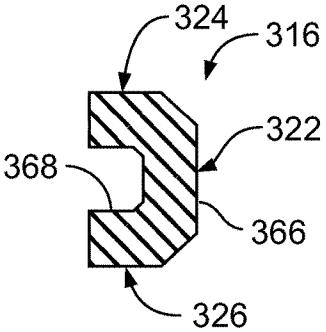
FIG. 7 illustrates a cross-section of the mating segment taken along the line 7-7 in FIG. 5.

FIG. 7 is a cross-section of the mating segment 316 at the line 7-7 shown in FIG. 5. As shown, the contact surface 322 includes an outwardly-facing surface 366 that faces an exterior of the mating segment 316 and an inwardly-facing surface 368 that faces another portion of the contact surface 322. In some embodiments, the entire contact surface 322 along the cross-section, except for the wipe runways 324, 326, is textured. In other embodiments, however, the entire contact surface 322 along the cross-section, including the wipe runways 324, 326, is textured. Yet in other embodiments, the contact surface 322 is selectively textured such that the contact surface 322 includes multiple textured areas along the stub portion 330 and/or such that the contact surface 322 has different degrees of texture.

Figure 8:
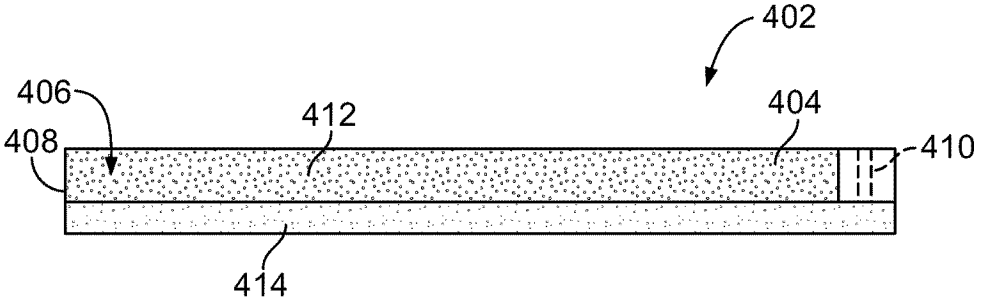
FIG. 8 is a top view of a portion of an electrical contact formed in accordance with an embodiment having a wipe runway that includes textured and smooth areas.
Figure 9:
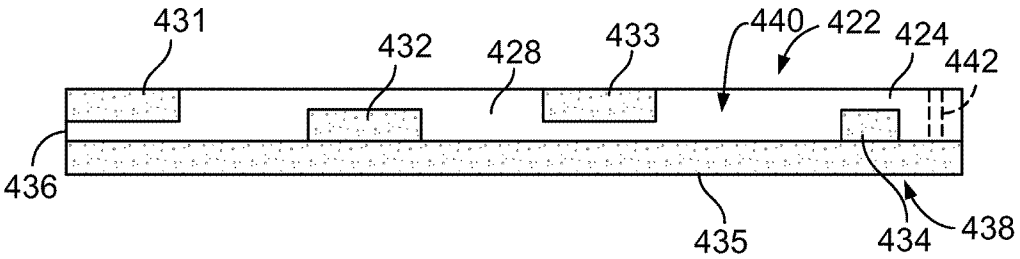
FIG. 9 is a top view of a portion of an electrical contact formed in accordance with an embodiment that includes textured and smooth areas.
Figure 10:
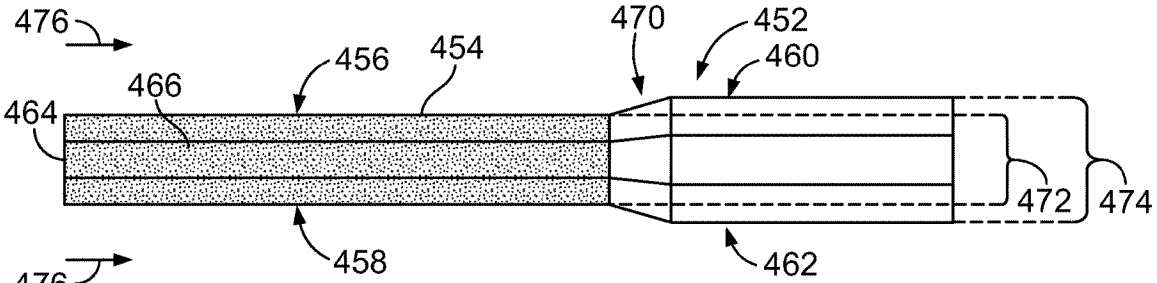
FIG. 10 is a side view of a portion of an electrical contact formed in accordance with an embodiment that has a mating segment with a non-planar shape.

For example, FIGS. 8-10 illustrate mating segments that are selectively textured. In each of these embodiments, the mating segments are configured to reduce wear that may be experienced by the other contact while simultaneously providing textured areas along a wipe runway for dampening electrical resonance. Each of the mating segments may be similar to the mating segment 316 (FIG. 4) and form a portion of an electrical contact, such as the electrical contact 300 (FIG. 4). Each of the mating segments has a corresponding stub portion during operation. FIG. 8 is a top view of a mating segment 402. As shown, the mating segment 402 has a contact surface 404 that forms a wipe runway 406. The wipe runway 406 is configured to slidably engage another contact (not shown) and extends from a leading end 408 of the mating segment 402 to a mating zone 410.

The contact surface 404 is selectively textured such that the contact surface 404 includes a first textured area 412 and a second textured area 414. The wipe runway 406 includes the first textured area 412. Non-engaging portions of the mating segment 402 include the second textured area 414. The non-engaging portions are portions of the mating segment 402 that do not engage the other contact during a wiping action or during normal operation. The first textured area 412 is less textured than the second textured area 414. For example, the first textured area 412 may have one or more surface parameters that are less than half (½), less than one-third (⅓), or less than one-fifth (⅕) the same surface parameters of the second textured area 414. In such embodiments, the other contact may experience less wear during a mating operation (or wiping action) compared to the wear that would be experienced if the first textured area 412 were more textured. Nevertheless, the first textured area 412 may contribute to the dampening effect along the mating segment 402.

FIG. 9 is a top view of a mating segment 422. The mating segment 422 has a contact surface 424 that is selectively textured to include multiple textured areas 431, 432, 433, 434, 435 and a smooth area 428. The smooth area 428 separates the textured areas 431-434 and is bordered by the textured area 435. The textured area 435 extends continuously along the mating segment 422, but along a non-engaging portion of the mating segment 422.

The smooth area 428 extends from a leading end 436 to a designated point 438. The mating segment 422 includes a wipe runway 440 that extends between the leading end 436 and a mating zone 442 that is proximate to the designated point 438. As shown, the textured areas 431-434 have different longitudinal positions along the wipe runway 440 and alternating lateral positions along the wipe runway 440. When an engagement area of another contact (not shown) engages the wipe runway 440, the engagement area may engage textured surfaces that cover only a portion of the total area of the wipe runway 440. For example, one side of the engagement area may slide along only the textured areas 431, 433 and an opposite side of the engagement area may slide along only the textured area 432, 434. In such embodiments, the other contact may experience less wear along the engagement area. In some cases, the textured areas 431-434 may be less textured than the textured area 435, as described above with respect to FIG. 8.

FIG. 10 is a side view of a mating segment 452 having a contact surface 454 that forms first and second wipe runways 456, 458. The wipe runways 456, 458 are configured to slidably engage another contact (not shown). The wipe runways 456, 458 extend from a leading end 464 of the mating segment 452 to respective mating zones 460, 462. As shown, the mating segment 452 includes a textured area 466 that extends from the leading end 464 to a ramp portion 470. As such, the wipe runways 456, 458 include the ramp portion 470 and have non-planar shapes. The wipe runways 456, 458 include the textured area 466.

The ramp portion 470 represents a portion of the mating segment 452 in which a cross-sectional profile of the mating segment 452 increases in size. For example, the mating segment 452 has a first diameter 472 along the portion of the mating segment 452 that includes the textured area 466, and a second diameter 474 along the portion that includes the mating zones 460, 462. The other contact (not shown) that engages the mating segment 452 may have contact fingers (not shown) that engage the wipe runways 456, 458 and move in the direction indicated by the arrows 476. However, due to the cross-sectional profile of the mating segment 452, the contact fingers may experience a smaller normal force along the textured area 466 than the normal force experienced at the mating zones 460, 462. In some cases, the contact fingers may only inadvertently engage the textured area 466 if the other contact is misaligned during the mating operation. Due to the smaller normal force and/or times at which the other contact does not engage the textured area 466, the other contact may experience less wear.

It should be understood that FIGS. 4-10 illustrate a select number of examples of electrical contacts that include textured areas along a stub portion. Other embodiments may include different configurations and/or dimensions. Other embodiments may include a combination of the features described above. For example, the mating segment 452 may include textured areas with differing degrees of texture or may include multiple textured areas that are separated by smooth area(s).

Figure 11:
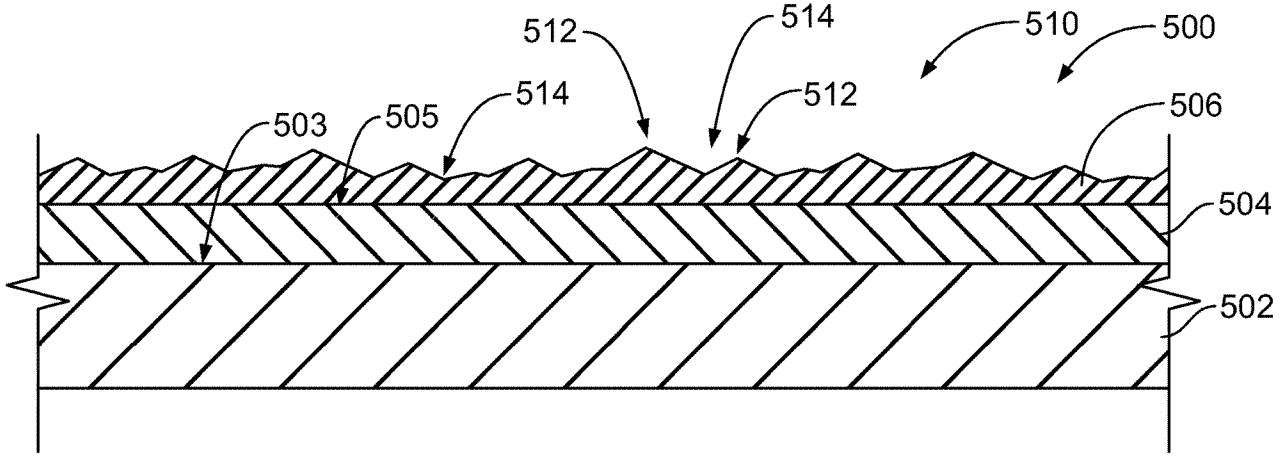
FIG. 11 is an enlarged cross-section of an electrical contact in accordance with an embodiment in which a plating layer is manufactured to include a textured area along an exterior of the electrical contact.

FIG. 11 is an enlarged cross-section of a portion of an electrical contact 500 in accordance with an embodiment. The electrical contact 500 includes a base layer (or base material) 502, an intervening or barrier layer 504 that is plated over the base layer 502, and a dampening layer 506 that is plated over the intervening layer 504. The base layer 502 may be a copper or copper alloy (e.g., beryllium copper). The intervening layer 504 may include nickel and/or tin and may function as a diffusion barrier between the base layer 502 and subsequent layers. In some embodiments, the dampening layer 506 may be a ferromagnetic material, such as nickel or other materials described above. Alternatively, the dampening layer 506 may be another material (e.g., precious metal material, such as gold). In other embodiments, the additional layer 506 is not used and the intervening layer 504 functions as the dampening layer.

As shown, the base layer 502 and the intervening layer 504 have essentially smooth exterior surfaces 503, 505, respectively. The dampening layer 506, however, has a textured surface 510 that includes numerous peaks 512 and troughs 514. The textured surface 510 may be provided by one or more subtractive or additive processes. Alternatively or in addition to the subtractive or additive processes, the textured surface 510 may be stamped. In such embodiments, the waviness of the textured surface 510 may be more regular or patterned than shown in FIG. 11.

Figure 12:
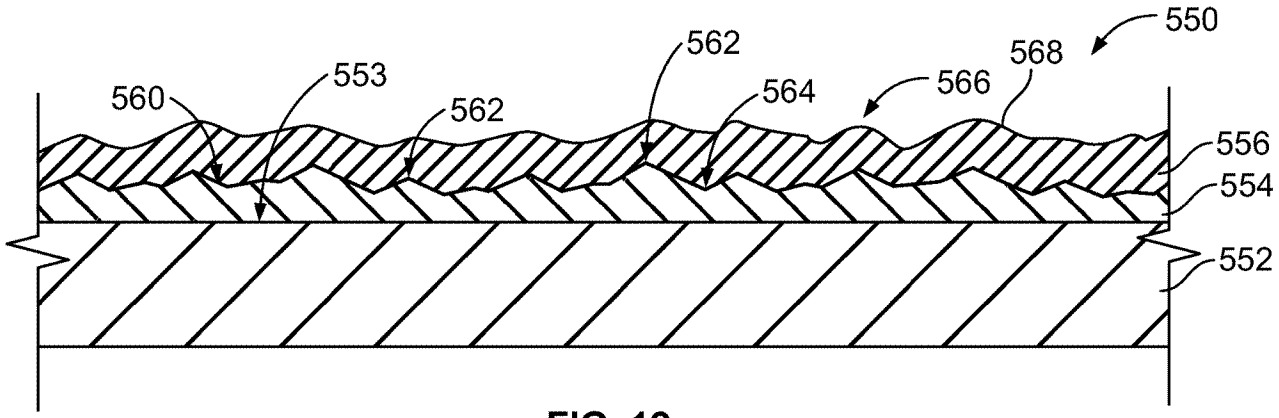
FIG. 12 is an enlarged cross-section of an electrical contact in accordance with an embodiment in which an intervening or base layer is manufactured to form a textured area along an exterior of the electrical contact.

FIG. 12 is an enlarged cross-section of a portion of an electrical contact 550 in accordance with an embodiment. The electrical contact 550 may be similar to the electrical contact 500 (FIG. 11) and includes a base layer (or base material) 552, an intervening or barrier layer 554 that is plated over the base layer 552, and a dampening layer 556 that is plated over the intervening layer 554. The base layer 552, the intervening layer 554, and the dampening layer 556 may comprise similar or identical materials as those described above with respect to FIG. 11.

The base layer 552 may have an essentially smooth exterior surface 553. The intervening layer 554, however, may have a textured surface 560 that includes numerous peaks 562 and troughs 564. During the manufacturing of the electrical contacts, the intervening layer 554 may be processed to include the textured surface 560 before the dampening layer 556 is plated over the intervening layer 554. In such embodiments, the textured surface 560 may cause a textured area 566 of a contact surface 568. The textured area 566 may be less textured than the textured surface 560, but may be sufficiently textured for providing the dampening effect described herein.

Although not shown or described above, electrical contacts set forth herein may also include a flash layer and/or a pore-blocking substance. Flash layers typically have relatively small thicknesses. The pore-blocking substance is typically the last material applied and is configured to reduce corrosion along the exterior surface. The pore-blocking substance may have a nominal effect upon the performance of the data transmission. Various methods may be used to apply the pore-blocking substance, such as spraying, brushing, dipping, and the like. Examples of pore-blocking substances that may be used with embodiments described herein include at least one of a polysiloxane (e.g. dimethyl polysiloxane, phenylmethyl polysiloxane), silicate ester, polychlorotrifluoro-ethylene, di-ester, fluorinated ester, glycol, chlorinated hydrocarbon, phosphate ester, polyphenyl ether, perfluoroalkyl polyether, poly-alpha-olefin, petroleum oil, organometallic compound, benzotriazole (BTA), mercaptobenzotriazole, self-assembled monolayer (SAM), or microcrystalline wax.

In some embodiments, the relative magnetic permeability of the designated material that is used for the dampening layer 556 may be measured at a predetermined frequency, such as 1 GHz or 5 GHz. For example, the relative magnetic permeability of the material of the dampening layer 556 at a predetermined frequency may be greater than 50. In some embodiments, the relative magnetic permeability of the material at the predetermined frequency is greater than 100 or, more specifically, greater than 300. In certain embodiments, the relative magnetic permeability of the material at the predetermined frequency is greater than 500 or, more specifically, greater than 600. As one example, the material of the dampening layer 556 may have a relative magnetic permeability of 500 or more at 1 GHz.

It should be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a connector housing configured to engage another connector; and a contact array including a plurality of electrical contacts coupled to the connector housing, each of the electrical contacts including a contact body having a mating segment and a base segment, the base segment being coupled to the connector housing, the mating segment extending in a direction from the base segment toward a contact end of the corresponding contact body, the mating segment having a contact surface that includes a mating zone located a distance from the contact end, the mating segment configured to intimately engage another contact of the other connector at the mating zone for electrical communication between the electrical contact and the other contact;

wherein the mating segment has a stub portion that extends between the contact end and the mating zone, at least a portion of the contact surface along the stub portion having a textured area that is more textured than the contact surface at the mating zone, the textured area configured to dampen reflected energy that propagates between the mating zone and the contact end.

2. The electrical connector of claim 1, wherein the stub portion has a wipe runway located between the contact end and the mating zone, the contact surface including a smooth area along the wipe runway, the other contact configured to slide along the wipe runway and the smooth area during a mating operation.

3. The electrical connector of claim 2, wherein the wipe runway extends from the contact end to the mating zone, the smooth area extending continuously between the contact end and the mating zone.

4. The electrical connector of claim 2, wherein the wipe runway is a first wipe runway, the respective contact body including a second wipe runway that is separate from and parallel to the first wipe runway.

5. The electrical connector of claim 2, wherein the wipe runway includes the smooth area and at least a portion of the textured area.

6. The electrical connector of claim 1, wherein the stub portion has a plating layer, the plating layer comprising a ferromagnetic material that increases a dampening effect of the textured area.

7. The electrical connector of claim 1, wherein the contact body includes an intervening layer and a plating layer that is plated over the intervening layer, the plating layer including the textured area, the intervening layer have a textured surface that causes the textured area along the plating layer.

8. The electrical connector of claim 1, wherein the textured area has at least one of (a) an average surface roughness that is at least two-and-a-half times (2.5×) an average surface roughness of the mating zone; (b) a root mean square roughness that is at least two-and-a-half times (2.5×) the root mean square roughness of the mating zone; or (c) a developed surface area ratio with respect to the mating zone that is at least 2.5:1.

9. An electrical contact comprising:

a mating segment configured to engage another contact and having a contact end and a contact surface, the contact surface including a mating zone that is located a distance from the contact end, the mating zone configured to intimately engage the other contact for electrical communication between the electrical contact and the other contact;

wherein the mating segment has a stub portion that extends between the contact end and the mating zone, at least a portion of the contact surface along the stub portion having a textured area that is more textured than the contact surface at the mating zone, the textured area configured to dampen reflected energy that propagates between the mating zone and the contact end.

10. The electrical contact of claim 9, wherein the stub portion has a wipe runway located between the contact end and the mating zone, the contact surface including a smooth area along the wipe runway, the other contact configured to slide along the wipe runway and the smooth area during a mating operation.

11. The electrical contact of claim 10, wherein the wipe runway extends from the contact end to the mating zone, the smooth area extending continuously between the contact end and the mating zone.

12. The electrical contact of claim 10, wherein the wipe runway is a first wipe runway, the contact surface including a second wipe runway that is separate from and parallel to the first wipe runway.

13. The electrical contact of claim 9, wherein the electrical contact includes an intervening layer and a plating layer that is plated over the intervening layer, the plating layer including the textured area, the intervening layer have a textured surface that causes the textured area along the plating layer.

14. The electrical contact of claim 9, wherein the stub portion has a plating layer, the plating layer comprising a ferromagnetic material that increases a dampening effect of the textured area.

15. The electrical contact of claim 9, wherein the textured area has at least one of (a) an average surface roughness that is at least two-and-a-half times (2.5×) an average surface roughness of the mating zone; (b) a root mean square roughness that is at least two-and-a-half times (2.5×) the root mean square roughness of the mating zone; or (c) a developed surface area ratio with respect to the mating zone that is at least 2.5:1.

16. An electrical contact comprising:

a mating segment configured to engage another contact and having a contact end and a contact surface, the contact surface including a mating zone that is located a distance from the contact end, the mating zone configured to intimately engage the other contact for electrical communication between the electrical contact and the other contact;

wherein the mating segment has a stub portion that extends between the contact end and the mating zone, at least a portion of the contact surface along the stub portion having a textured area that is configured to dampen reflected energy that propagates between the mating zone and the contact end, the textured area having an average surface roughness of at least 1.0 μm.

17. The electrical contact of claim 16, wherein the average surface roughness of the textured area is at least 2.0 μm and the mating zone has an average surface roughness of at most 0.7 μm.

18. The electrical contact of claim 16, wherein the stub portion has a wipe runway located between the contact end and the mating zone, the contact surface along the wipe runway including a smooth area having an average surface roughness of at most 0.7 μm, the other contact configured to slide along the wipe runway and the smooth area during a mating operation.

19. The electrical contact of claim 16, wherein the contact body includes an intervening layer and a plating layer that is plated over the intervening layer, the plating layer including the textured area, the intervening layer have a textured surface that causes the textured area along the plating layer.

20. The electrical contact of claim 16, wherein the stub portion has a plating layer, the plating layer comprising a ferromagnetic material that increases a dampening effect of the textured area.

* * * * *